US007246725B2

(12) United States Patent
Schiestl et al.

(10) Patent No.: US 7,246,725 B2
(45) Date of Patent: Jul. 24, 2007

(54) PRESSURE CONTAINER AND METHOD FOR MANUFACTURING AND/OR FILLING OF PRESSURE CONTAINER

(75) Inventors: Ulrich Schiestl, Feldkirch (AT); Ulrich Rosenbaum, Wangs (CH); Hans Gschwend, Buchs (CH); Iwan Wolf, Chur (CH)

(73) Assignee: Hilti Aktiengesellschaft, Schaan (LI)

( * ) Notice: Subject to any disclaimer, the term of this patent is extended or adjusted under 35 U.S.C. 154(b) by 525 days.

(21) Appl. No.: 10/828,764

(22) Filed: Apr. 20, 2004

(65) Prior Publication Data

US 2004/0211793 A1 Oct. 28, 2004

(30) Foreign Application Priority Data

Apr. 24, 2003 (DE) ..... 103 18 576

(51) Int. Cl.
*B65D 83/14* (2006.01)

(52) U.S. Cl. ..... 222/386.5; 222/399; 141/25

(58) Field of Classification Search ..... 222/386.5, 222/399; 141/25; 53/470
See application file for complete search history.

(56) References Cited

U.S. PATENT DOCUMENTS 4,360,131 A * 11/1982 Reyner ..... 222/386.5
4,870,805 A * 10/1989 Morane ..... 53/470
4,896,794 A * 1/1990 Banks et al. ..... 222/1

* cited by examiner

*Primary Examiner*—Philippe Derakshani
(74) *Attorney, Agent, or Firm*—Abelman, Frayne & Schwab

(57) ABSTRACT

The present invention relates to a pressurized package and a method for manufacturing and filling a pressurized package. The pressurized package has an outer container (10) and an inner container (20) situated within the outer container (10). In the outer container (10) a chamber (11) for material (12) to be dispensed is arranged and in the inner container (20) a propellant chamber (21) for propellant (20) is arranged, which are separated from each other in a manner that is impermeable to liquid and gas. The outer container (10) is closed by a cover part (15) on which a valve part (16) is arranged for dispensing the material (12) from the chamber (11) outwards. To improve pressurized packages of this type, a pressurized cartridge (30) containing a propellant (22) is arranged in the inner container (20), and the pressurized cartridge is associated with an opening mechanism (31) for at least one-time opening of the pressurized cartridge (30) to the propellant chamber (21) of the inner container (20). The opening mechanism (31) reacts to filling of the chamber (11) with material (12) to be dispensed.

8 Claims, 6 Drawing Sheets

PRESSURE CONTAINER AND METHOD FOR MANUFACTURING AND/OR FILLING OF PRESSURE CONTAINER

BACKGROUND OF THE INVENTION

The present invention relates to a pressure container and a method for manufacturing and filling a pressure container. The pressurized package has an outer container and an inner container within the outer container. In the outer container a chamber for material to be dispensed is arranged and in the inner container a propellant chamber for propellant is arranged, which are separated from each other in a manner that is impermeable to liquid and gas. The outer container is closed by a cover part on which a valve part is arranged for dispensing the material from the chamber outwards. To improve pressurized packages of this type, a pressurized cartridge containing a propellant is arranged in the inner container, and the pressurized cartridge is associated with an opening mechanism for at least one-time opening of the pressurized cartridge to the propellant chamber of the inner container. The opening mechanism reacts to filling of the chamber with material to be dispensed.

This type of container is used, for example, in gas operated setting tools, wherein they contain a dispensable fuel.

Liquid hydrocarbons stored in the pressure containers is used to drive the aforementioned setting tools. The replaceable pressure containers or gas bottles are equipped with a dosing head, which is fastened onto the gas bottle by means of a snap-on connection. The pressure container/gas bottle and dosing head system is then introduced into the setting tool.

In the case of the pressure container, it is desirable that there is no penetration of propellant into the material to be dispensed chamber and that there is no escape of propellant or material to be dispensed into the environment. It is also desirable to attain a maximum fill volume of material to be dispensed or fuel in the pressure container.

U.S. Pat. No. 5,069,590 discloses a pressure container, wherein an inner thin-walled metal container, in particular one made of aluminum, is arranged in an external, thick-walled container (e.g., likewise made of aluminum). At the opening of the pressure container, the two containers are rolled onto each other, whereby the opening is closed with a cover part, in which a valve is arranged. When this is done, the material to be dispensed is arranged inside the inner container, while the propellant is arranged in the outer container. In this case, the propellant is introduced into the outer container through a rubber stopper arranged in the floor of the pressure container, in that the rubber stopper is perforated using a needle. The drawback here is that when acceleration forces act upon the pressure container, the inner container, because of the relatively large fill volume with material to be dispensed, is heavily mechanically stressed. Furthermore, there can be a loss of propellant from the outer container at the rolled flanged edge. The ratio of propellant to medium to be dispensed in the case of fuel—pressurized packages for setting tools is approx. 5/40 (e.g. 5 g/40 g). Particularly in longer periods of storage, therefore, with a loss of 3–4 g of propellant/year, the pressurized package can become unusable in virtue of the loss of propellant.

It is therefore advantageous if the propellant is arranged in the inner container, because a loss of material to be dispensed or fuel, affects the operation of the pressurized package less seriously than a loss of propellant.

U.S. Pat. No. 4,360,131 discloses a pressurized package, wherein the propellant is arranged in an inner container and the material to be dispensed is in an outer container. The inner container is sealed and contains a propellant, which comprises at least two constituents. After the lapse of a pre-determined interval of time after manufacturing and filling of the pressurized package, the formation of the propellant is done by combining its constituents. The advantage in this instance is that there is no connection favoring diffusion between the inner container and the valve.

The drawback in this instance is the use of a propellant comprised of two or more constituents, which results in relatively high manufacturing costs. It is difficult to generate a propellant pressure that is sufficient to maintain a gaseous fuel in the pressurized package completely in its liquid phase at ambient pressure and temperature.

SUMMARY OF THE INVENTION

The object of the present invention is to develop a pressurized package and a method for manufacturing and filling a pressurized package, which eliminates the aforementioned drawbacks and is economical to manufacture. This object is achieved by in accordance with the invention resides wherein a pressurized package is arranged with the propellant in the inner container, on which an opening mechanism is arranged relative to the propellant chamber of the inner container for at least one-time opening of the pressurized package. In his way, the opening mechanism is configured such that it reacts to the filling with material to be dispensed of the chamber containing the material to be dispensed. The propellant can therefore consist of only one component and is present as a liquid phase in the cartridge. The cartridge is automatically opened by means of the opening mechanism upon filling of the external container with material to be dispensed, which is done via the output valve. The propellant can then occupy the entire inner container and the material to be dispensed in the outer container such as the fuel, is held completely in its liquid phase by virtue of its vapor pressure. In this case, the opening reaction of the opening mechanism upon filling of the outer container with material to be dispensed can be initiated by a change in temperature or pressure. The pressurized package according to the invention is particularly suited for storage and dispensing of fuels under pressure and is completely operational even after longer periods of storage (e.g. >1 year).

It is advantageous if the inner container is made of a foil of plastic. This type of foil inner container has the required flexibility to exert the pressure of the propellant optimally on the material to be dispensed in the outer container. It is further advantageous, if the inner container is made of a laminated foil, which has a very good seal vis-à-vis liquid and gaseous media.

In another advantageous further development of the invention, the opening mechanism is configured to react to an increase in pressure in the chamber containing the material to be dispensed and connect the pressure container with the propellant chamber. In this fashion, the increase in pressure from the ambient pressure to the filling pressure, at the time of filling the outer container with the material to be dispensed, can be used to activate the opening mechanism.

When this is done it can be advantageous if the opening mechanism has a pressure-sensitive actuator member, which co-operates with a closure means. Using this actuator member, a closure or a closing valve can be actuated in simple fashion, when the actuator member is acted upon by the filling pressure.

The pressure sensitive actuator member can be placed on a container wall of the inner container or it may even be bonded to same, so that loading with the with the filling pressure of the material to be dispensed is effected indirectly via the container wall. In this fashion, the seal problems at interfaces between inner and outer containers are prevented.

In an advantageous variant of the invention, the closure means for the cartridge or the cartridge itself has an intentional break zone that can be opened using the pressure sensitive actuator member.

In a further advantageous variant of the invention, the closure means has a valve means, which can be moved into an open position using the pressure sensitive actuator member. The pressure sensitive actuator member can be elastically biased in the direction of the open position of the valve means.

A method according to the invention for manufacturing a pressurized package according to the invention includes the following process steps:

Filling propellant into a pressurized cartridge, that is provided with an opening mechanism, which is configured in such a way as to react to the material to be dispensed;

Incorporating the pressurized cartridge in blank for creating an inner container;

Sealing the inner container and incorporation of the inner container in an outer container;<<

Sealing the outer container;

Filling the outer container with material to be dispensed and activation of the opening mechanism by the material to be dispensed for automatic output of the propellant from out of the pressurized cartridge in the inner container.

By means of this process and advantageous and reliable manufacturer of the pressurized package according to the invention is possible, which is still completely operational after a longer period of storage (>1 year). The method is also particularly suited for manufacturing fuel—pressurized packages.

BRIEF DESCRIPTION OF THE DRAWINGS

Other advantages and features of the invention will become apparent from the following description with reference to the drawings, wherein.

DETAILED DESCRIPTION OF THE INVENTION

Figure 1:
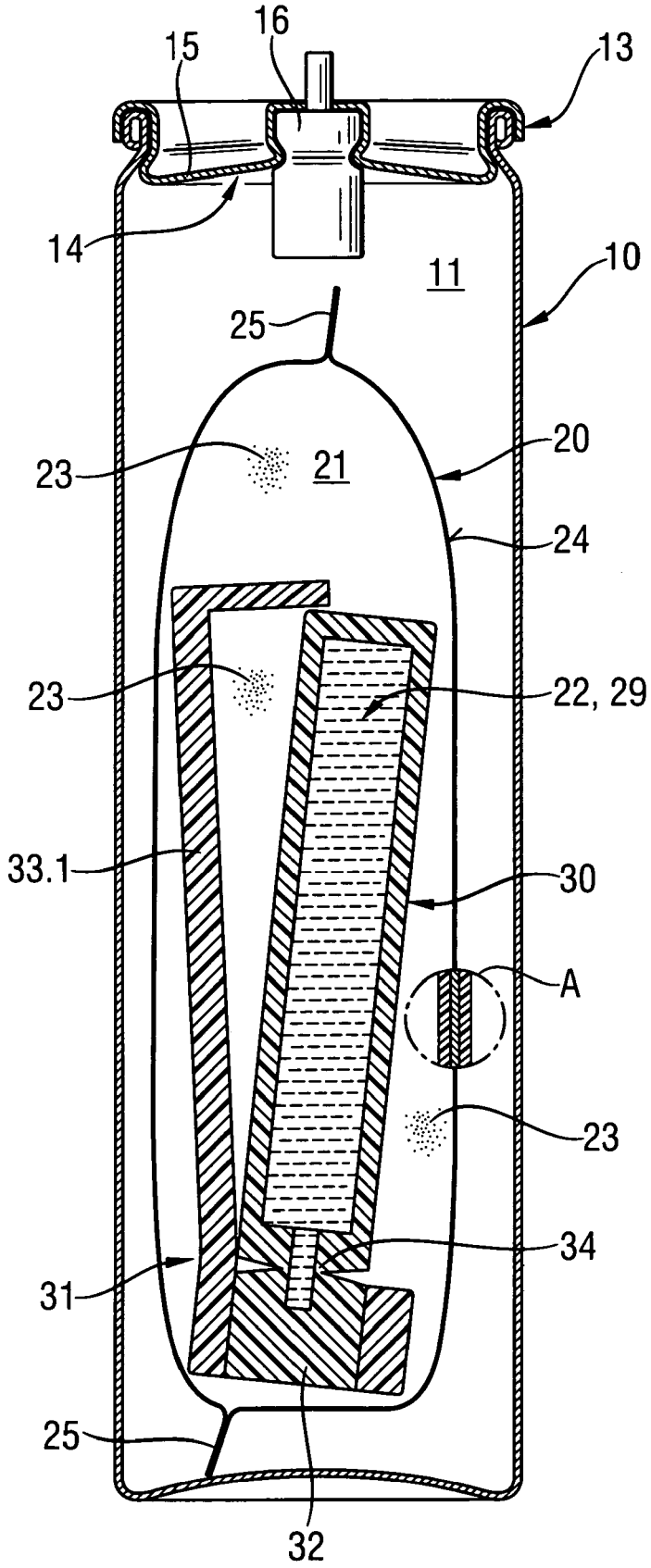
FIG. 1 shows a pressurized package according to the invention in longitudinal section in an unfilled condition.
Figure 2:
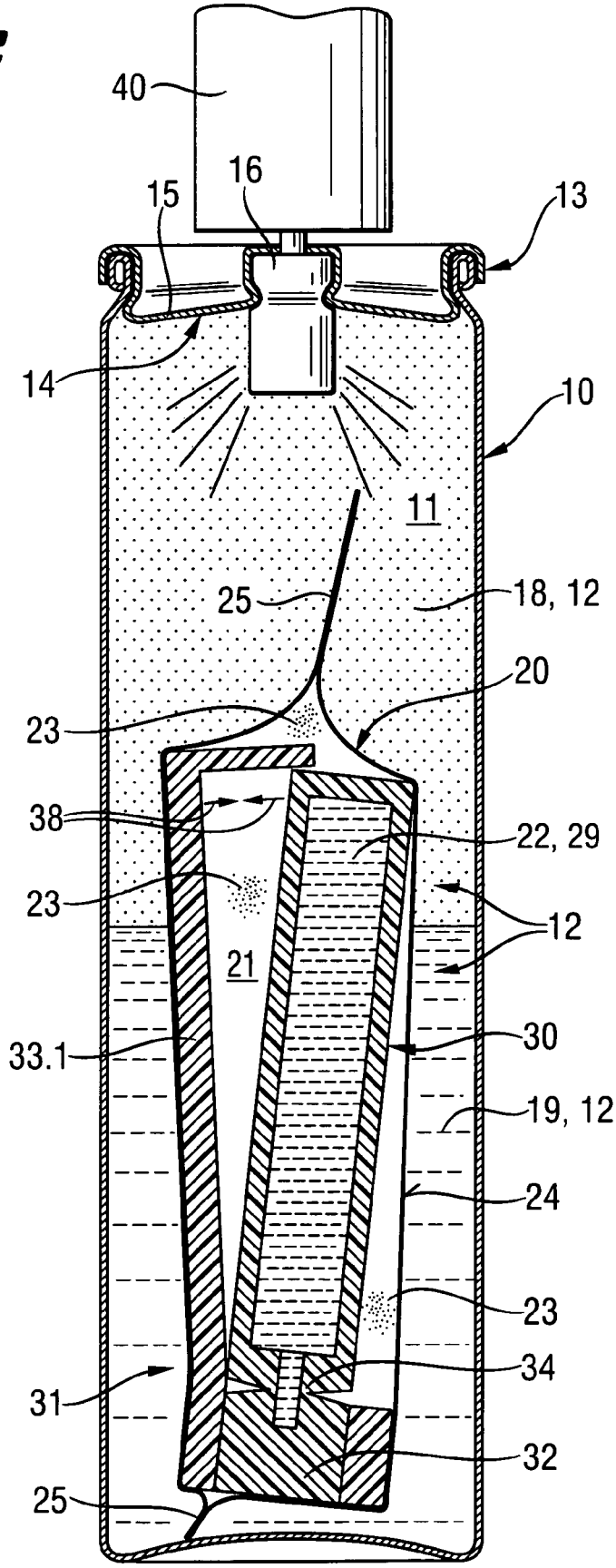
FIG. 2 shows the pressurized package according to the invention of FIG. 1 in a partially filled condition.
Figure 3:
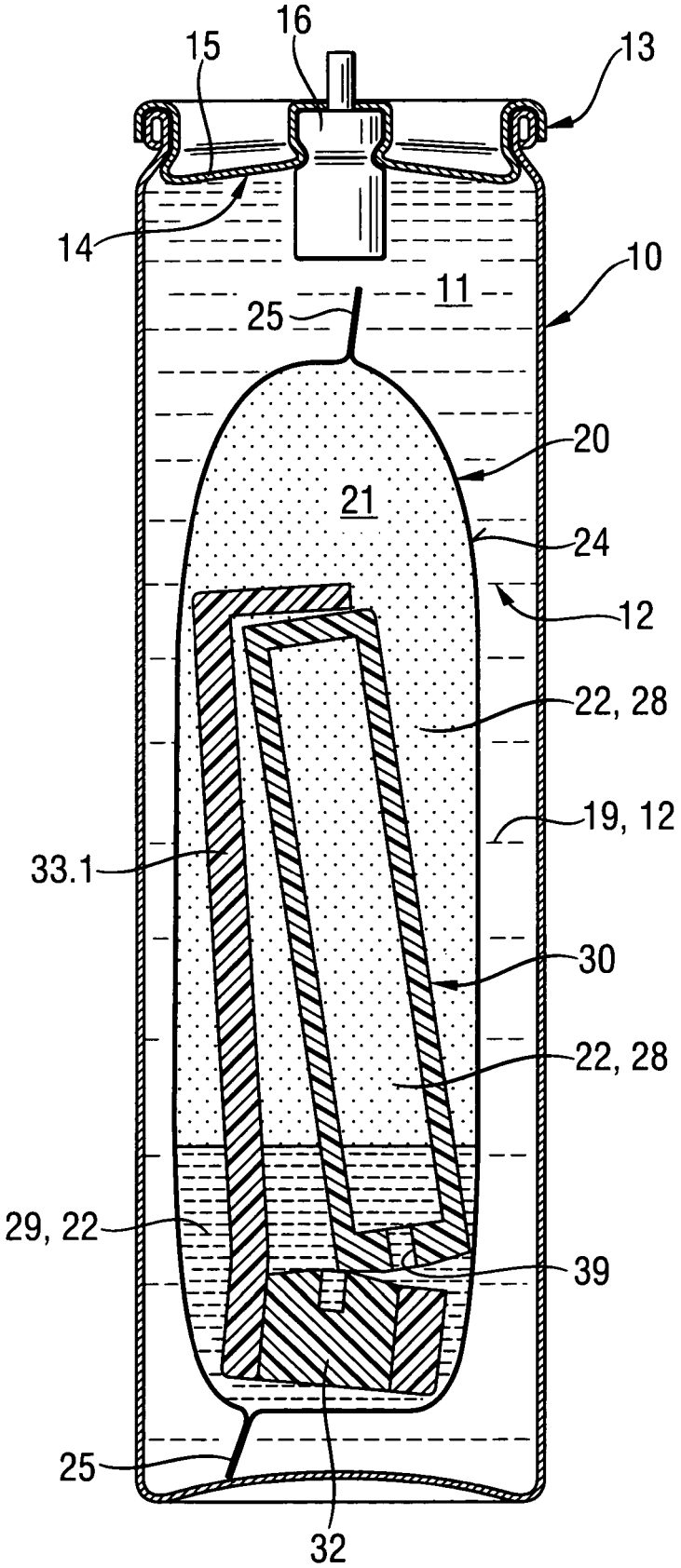
FIG. 3 shows the pressurized package according to the invention of FIG. 1 in a completely filled condition.

FIGS. 1 to 3 represent a pressurized package according to the invention, which includes an outer container 10 and an inner container 20. In this exemplary embodiment, the outer container 10 is made of a relatively thick-walled metal material such as aluminum, for example, whilst the inner container 20 has a container wall 24 made of a relatively thin-walled laminated foil. This laminated foil is comprised, for example, of three, represented here in a cutout A, layers. An inner plastic layer such as a PE bonded layer, for example, a metal layer or foil and an outer plastic layer such as a PE bonded layer. The metal layer, which consists of aluminum, for example, is used as a barrier layer for liquid and gaseous media such as a fuel gas, for example.

The inner container 20 is configured as a pouch, which is not bonded to the outer container 10 or attached thereto. Prior to sealing of the inner container 20 at the seams 25, a pressurized cartridge 30 containing propellant 22 is incorporated into the inner container 20. As can be seen in FIG. 1, the propellant chamber 21 of the inner container 20 contains air 23 after being sealed.

An opening 14, through which the inner container 20 was brought into the outer container 10, is sealed impermeable to the media with a cover part 15 using a rolled flange 13. A valve part 16 is arranged in the cover part 15, which is sealed against the cover part 15. The valve part 16 is used in the filling and dispensing of material to be dispensed 12 into/out of a chamber 11 for material to be dispensed in the outer container 10. The material 12 to be dispensed can be a combustible liquid gas.

The pressurized cartridge 30 filled with liquid propellant 22 is sealed using a closure means 32. An opening mechanism 31 is arranged on the closure means 32; said mechanism including a pressure sensitive actuator member 33.1 and a intentional break point 34. The actual pressurized cartridge 30 and the pressure sensitive actuator member 33.1 are arranged therefor at an angle to each other as shown in the starting position represented in FIG. 1.

For filling the pressurized package, material to be dispensed 12 is incorporated via a filling nozzle 40 through the valve means 16 into the pressurized package. When filling, the increasing pressure in the outer container 10 further compresses the inner container 20 and the air 23 contained therein until finally the pressure sensitive actuator member 33.1, which is configured as a plate-like component and the pressure cartridge 30 are moved towards each other in the direction of the arrow (compare FIG. 2). In that the pressurized cartridge 30 and the pressure sensitive actuator member 33.1 of the opening mechanism 31 are moved towards each other, a force is exerted on the intentional break point 34. This ultimately results in the pressurized cartridge 30 breaking off of the closure means at the intentional break point 34 and a channel 39 between the inner space of the pressurized cartridge and the propellant chamber 21 of the inner container 20 being opened. In this way, the propellant 22, which is under high pressure, can escape out of the pressurized cartridge 30 and occupy the propellant chamber 21 of the inner container 20. Since the partial pressure of the propellant 22 in its gaseous phase 28 is greater than the partial pressure of the material to be dispensed 12 in the gaseous phase 18, the material to be dispensed is transferred completely in its liquid phase (cf FIG. 3). In the process, the inner container 20 expands. The pressurized package represented in FIG. 3 is ready for operation and represents the finished end product. The material to be dispensed contained in the outer container 10 can be removed to almost complete emptying of the outer container 10 via the valve means 16 from same.

Figure 4:
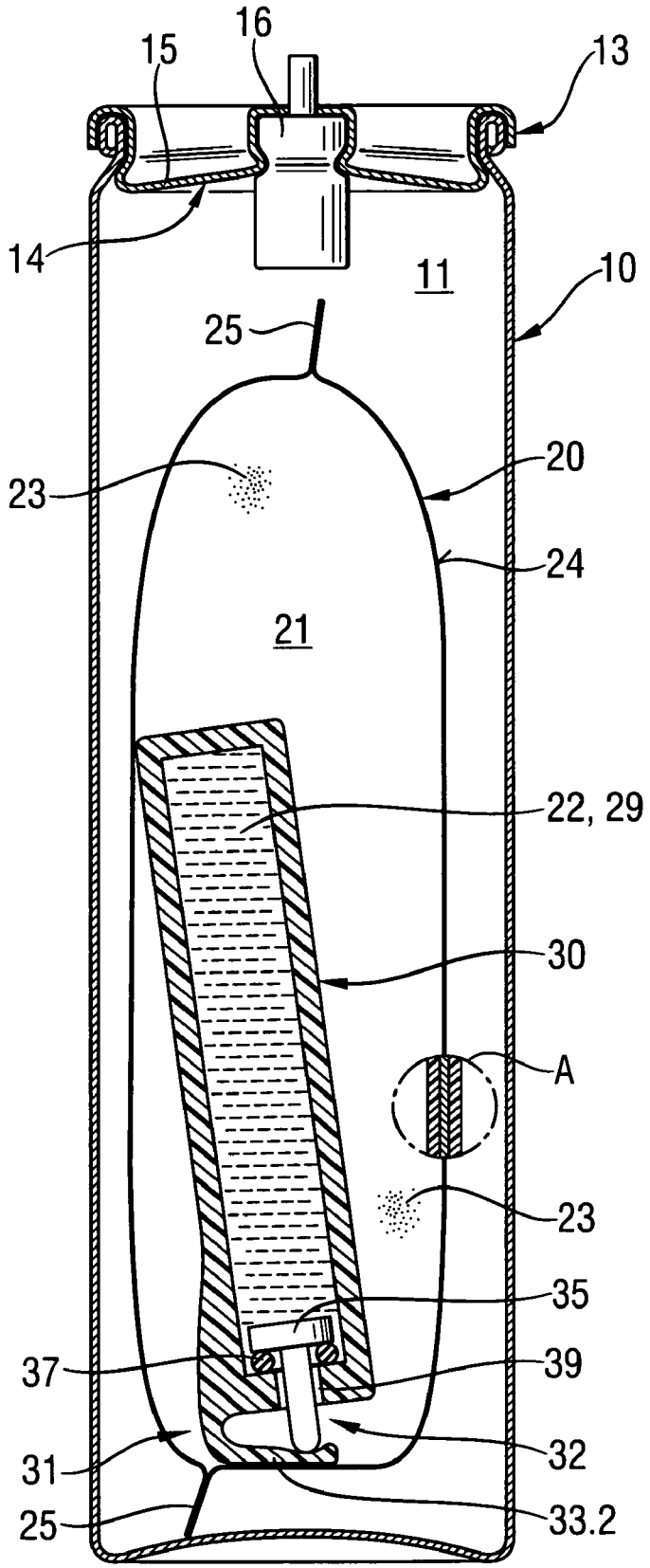
FIG. 4 shows a pressurized package according to the invention in longitudinal section in an unfilled condition.
Figure 5:
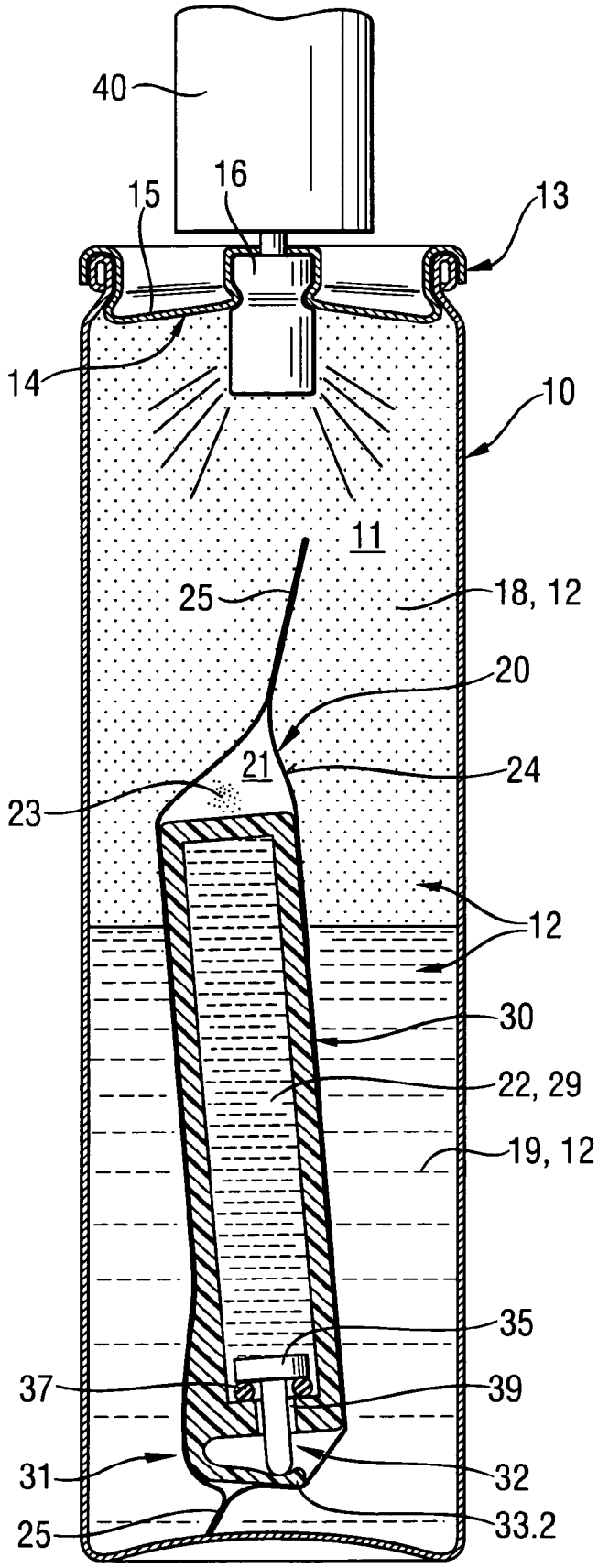
FIG. 5 shows the pressurized package according to the invention of FIG. 4 in a partially filled condition.
Figure 6:
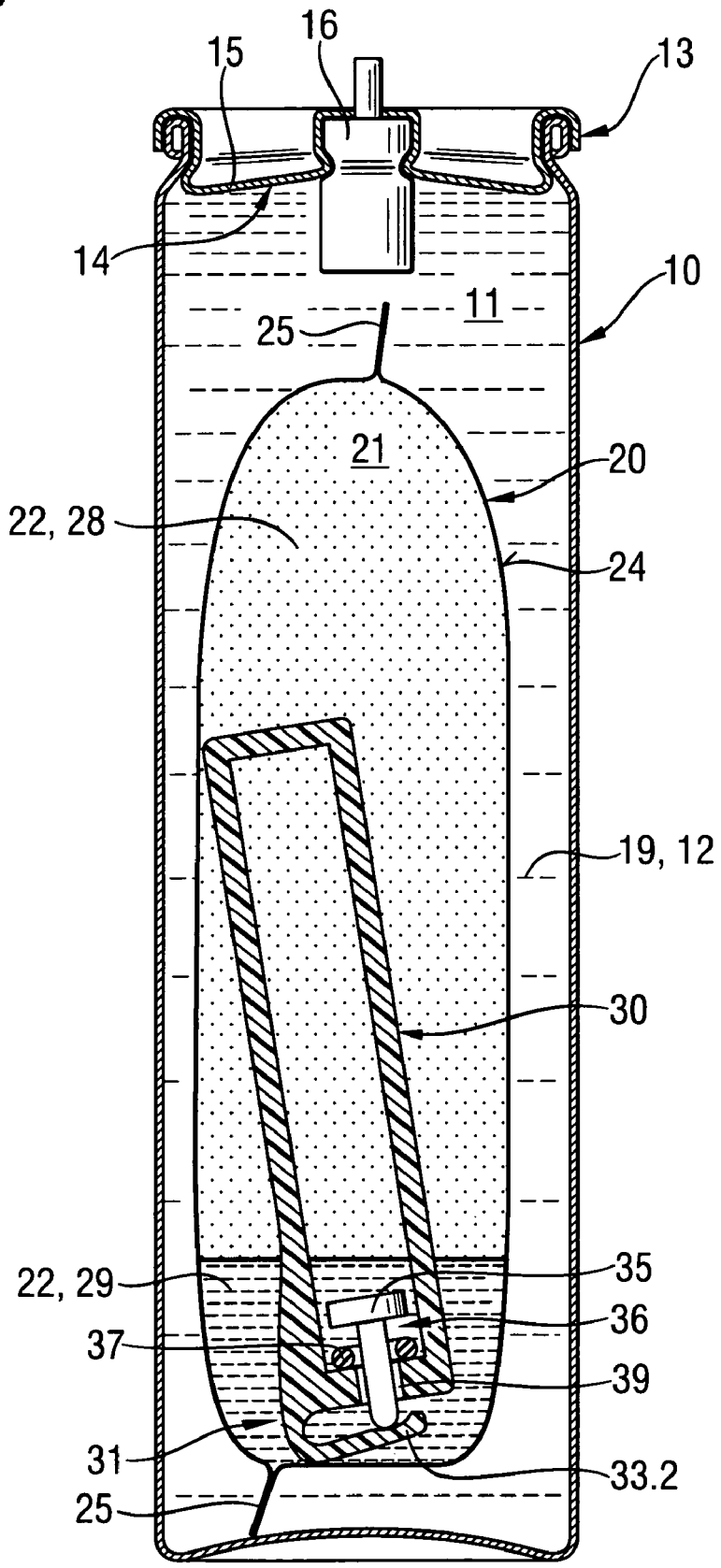
FIG. 6 shows the pressurized package according to the invention of FIG. 4 in the completely filled condition.

The variant of a pressurized package according to the invention represented in FIG. 4 to 6 differ from the previously described pressurized package in that the pressurized cartridge 30 has another opening mechanism 31. This opening mechanism 31 includes a valve means 35, which closes via a seal 37—in the starting position represented in FIG. 4—the channel 39 as the outlet of the pressurized cartridge 30. The valve means 35 is held in this closed position by the pressure of the propellant 22 acting on it, said propellant being situated in the inner space of the pressurized cartridge 30. A pressure sensitive actuator member 33.2, which acts upon the valve means 35 elastically biased in the direction of opening, cannot open the closure 32 in the starting position represented in FIG. 4. If the pressurized package according to the invention, as can be seen in FIG. 5, is filled via a filling nozzle 40 at the valve means 16 with a material 12 to be dispensed, then, as already described, the inner container 20 and the air 23 contained therein, is compressed by the gaseous 18 and liquid 19 material 12 to be dispensed therein, until the inner container 20 almost completely abuts on the pressurized cartridge 30 and the opening mechanism 31. If the pressurized package is filled again and the pressure of the chamber 11 containing the material to be dispensed again increases, then the valve means 35 is urged into the inner space of the pressurized cartridge 30 by the pressure sensitive actuator member 33.2, as represented in FIG. 6. As soon as the valve means 35 opens up the channel 39, the propellant flows out of the pressurized cartridge 30 into the propellant chamber 21 of the inner container 20. As a result, the inner container 20 expands, whereby, because of the higher partial pressure of the propellant 22 in its gaseous phase 28, the material 12 to be dispensed transferred completely in its liquid phase 19. The pressurized package according to the invention is now ready for operation.

Manufacturing and filling of a pressurized package according to the invention can thus comprise the following steps : A pressurized cartridge 30 is filled with a propellant 22 and sealed by the previously described closure means 32. The pressurized cartridge 30 is incorporated into a foil sleeve made of laminated film and this film sleeve is sealed at seams 25 to form an inner container 20. Hereby, air 23 is trapped in the inner space or in the propellant chamber 21 of the inner container 20. The inner container 20 prepared in this fashion is incorporated into an outer container 10 and the outer container 10 is sealed at its opening 14 with a cover part 15 (FIGS. 1 and 4). In a further step, the pressurized package is filled, via a valve means 16 arranged in the cover part 15, with a material 12 to be dispensed. By virtue of this filling with material 12 to be dispensed, as has already been described above, the propellant 22 is automatically released from the pressurized cartridge 30 through the opening closure means 32 so that the material 12 to be dispensed that is present in the outer container 10, which is present during the filling process in a gaseous phase 18 and in a liquid phase 19 in the outer container 10 (compare FIGS. 2 and 5), is then transferred completely in its liquid phase 19 (compare FIGS. 3 and 6).

What is claimed is:

1. A pressurized package having an outer container (10) and an inner container (20) situated in the outer container (10), wherein a chamber (11) for material (12) to be dispensed is arranged in the outer container (10) and a propellant chamber (21) for propellant (22) is arranged in the inner container (20), the outer container (10) and the inner container (20) are separated from each other in one of a fluid-and gas-tight manner, and have a cover part (15) for closing at least the outer container (10), a valve part (16) is arranged on the cover part (15) for outwardly dispensing material (12) from the chamber (11), wherein a pressurized cartridge (30) containing the propellant (22) is arranged in the inner container (20), and an opening mechanism (31) is associated with the pressurized cartridge (30) for at least one-time opening of the pressurized cartridge (30) to the propellant chamber (21) of the inner container (20), whereby the opening mechanism (31) is configured to react to a filling of the chamber (11) for the material (12) to be dispensed.

2. The pressurized package of claim 1, wherein the inner container (20) consists of a film configured as a laminated film.

3. The pressurized package of claim 1, wherein the opening mechanism (31) reacts upon an increase in pressure in the chamber (11) for the material to be dispensed and connects the inner space of the pressurized package (30) with the propellant chamber (21).

4. The pressurized package of claim 1, wherein the opening mechanism (31) has a pressure sensitive actuator member (33.1, 33.2) that co-operates with a closure means (32).

5. The pressurized package of claim 4, wherein the pressure sensitive actuator member (33.1, 33.2) is acted upon by a container wall (24) of the inner container (20) with the filling pressure of the material (12) to be dispensed.

6. The pressure package of claim 4, wherein the closure means (32) has an intentional break point (34) that is opened by the pressure sensitive actuator member (33.1).

7. The pressurized package of claim 4, wherein the closure means (32) has a valve means (35) that is moved via the pressure sensitive actuator member (33.2) into an open position (36).

8. The pressurized package of claim 4, wherein the pressure sensitive actuator member (33.2) is elastically biased in the direction towards the open position (36) of the valve means (35).

* * * * *